US010967243B2

(12) United States Patent
Fellin

(10) Patent No.: US 10,967,243 B2
(45) Date of Patent: Apr. 6, 2021

(54) SKI BINDING

(71) Applicant: FISCHER SPORTS GMBH, Ried/Innkreis (AT)

(72) Inventor: Nicolas Fellin, Neuhofen im Innkreis (AT)

(73) Assignee: FISCHER SPORTS GMBH, Ried/Innkreis (AT)

( * ) Notice: Subject to any disclaimer, the term of this patent is extended or adjusted under 35 U.S.C. 154(b) by 215 days.

(21) Appl. No.: 16/312,969

(22) PCT Filed: Jun. 23, 2017

(86) PCT No.: PCT/EP2017/065518
§ 371 (c)(1),
(2) Date: Dec. 21, 2018

(87) PCT Pub. No.: WO2017/220771
PCT Pub. Date: Dec. 28, 2017

(65) Prior Publication Data

US 2019/0224559 A1 Jul. 25, 2019

(30) Foreign Application Priority Data

Jun. 23, 2016 (EP) ..... 16175941

(51) Int. Cl.
*A63C 9/00* (2012.01)
*A63C 9/08* (2012.01)
(Continued)

(52) U.S. Cl.
CPC ..... *A63C 9/005* (2013.01); *A63C 9/086* (2013.01); *A63C 9/0807* (2013.01); *A63C 9/18* (2013.01)

(58) Field of Classification Search
CPC ..... A63C 9/005; A63C 9/0807; A63C 9/086; A63C 9/18
See application file for complete search history.

(56) References Cited

U.S. PATENT DOCUMENTS 4,310,170 A * 1/1982 Linecker ..... A63C 9/20 280/607
4,522,424 A 6/1985 Luitz et al.
(Continued)

FOREIGN PATENT DOCUMENTS

AT 385204 B 3/1988
CH 177960 A 6/1935
(Continued)

OTHER PUBLICATIONS

China National Intellectual Property Administration, Office Action and Search Report Issued in Application No. 201780037853.4, dated Jul. 2, 2019, 12 pages.
(Continued)

*Primary Examiner* — Jacob B Meyer
(74) *Attorney, Agent, or Firm* — McCoy Russell LLP

(57) ABSTRACT

A ski binding with a binding element mounted displaceably on a slide rail arranged on a ski and which can be fixed in different positions by a latching device, wherein the latching device has latch elements which engage in each other in a blocking position on the binding and ski sides, and the binding-side latch element has a pivotable lever element that in a displacement position the latch elements are not in engagement with each other, wherein the binding element has an operating element with an oblique run-on surface which is transferred between open and closed positions, wherein the operating element, upon transfer of the operating element to the open position, cooperates with an oblique contact surface of the lever element such that the lever element is moved out of the blocking position.

19 Claims, 7 Drawing Sheets

(51) Int. Cl.
*A63C 9/086* (2012.01)
*A63C 9/18* (2012.01)

(56) References Cited

U.S. PATENT DOCUMENTS

| | | | | | |
|---|---|---|---|---|---|
| 5,056,809 | A * | 10/1991 | Brischoux | A63C 9/005 | 280/617 |
| 5,431,427 | A * | 7/1995 | Pieber | A63C 9/003 | 280/602 |
| 5,975,555 | A * | 11/1999 | Lehner | A63C 5/07 | 280/607 |
| 6,050,591 | A * | 4/2000 | Bardin | A63C 9/00 | 280/633 |
| 6,065,895 | A * | 5/2000 | Lehner | A63C 5/07 | 280/618 |
| 6,209,903 | B1 * | 4/2001 | Girard | A63C 9/20 | 280/615 |
| 6,631,918 | B2 * | 10/2003 | Silva | A63C 5/04 | 280/607 |
| 7,014,207 | B2 * | 3/2006 | Humann | A63C 9/005 | 280/618 |
| 7,264,263 | B2 * | 9/2007 | Riedel | A63C 9/20 | 280/614 |
| 7,887,080 | B2 * | 2/2011 | Hauglin | A63C 9/005 | 280/615 |
| 7,988,180 | B2 * | 8/2011 | Holzer | A63C 9/005 | 280/616 |
| 8,460,505 | B2 * | 6/2013 | Bjertnaes | A63C 9/003 | 156/314 |
| 9,776,065 | B2 * | 10/2017 | Bjertnaes | A63C 5/128 | |
| 9,782,663 | B2 * | 10/2017 | Bjertnaes | A63C 9/005 | |
| 2004/0051278 | A1 * | 3/2004 | Humann | A63C 9/005 | 280/618 |
| 2006/0145452 | A1 * | 7/2006 | Bjertnaes | A63C 9/00 | 280/607 |
| 2008/0203703 | A1 * | 8/2008 | Hauglin | A63C 5/003 | 280/607 |
| 2013/0241179 | A1 * | 9/2013 | Wollo | A63C 9/003 | 280/611 |
| 2019/0224559 | A1 * | 7/2019 | Fellin | A63C 9/18 | |

FOREIGN PATENT DOCUMENTS

| | | | |
|---|---|---|---|
| CN | 101578122 | A | 11/2009 |
| CN | 104797308 | A | 7/2015 |
| DE | 3428566 | A1 | 2/1986 |
| EP | 0084324 | A1 | 7/1983 |
| EP | 2090338 | A1 | 8/2009 |
| WO | 2015140258 | A1 | 9/2015 |

OTHER PUBLICATIONS

ISA European Patent Office, International Search Report Issued in Application No. PCT/EP2017/065518, dated Oct. 9, 2017, WIPO, 4 pages.

* cited by examiner

SKI BINDING

CROSS-REFERENCE TO RELATED APPLICATIONS

The present application is a U.S. National Phase of International Patent Application Serial No. PCT/EP2017/065518 entitled "SKI BINDING," filed on Jun. 23, 2017. International Patent Application Serial No. PCT/EP2017/065518 claims priority to European Patent Application No. 16175941.0, filed on Jun. 23, 2016. The entire contents of each of the above-cited applications are hereby incorporated by reference in their entirety for all purposes.

TECHNICAL FIELD

The invention relates to a ski binding, in particular a cross-country binding, with a binding element, which is mounted displaceably on a slide rail provided for arrangement on a ski and the arrangement of the binding element, viewed in the longitudinal direction of the slide rail, can be fixed in different positions by means of a latching device, wherein the latching device comprises latching elements which engage in each other in a blocking position on the binding side and on the ski side, and the binding-side latching element comprises a lever element which is pivotable about a pivot axis in such a way that, in a displacement position, the latching elements are not in engagement with each other and the binding element is mounted displaceably with respect to the slide rail.

BACKGROUND

The most diverse slide rails and binding plates are already known in the prior art, on which in particular a binding element of a cross-country binding is mounted displaceably. In order to adjust the arrangement of the binding element individually on the ski or with respect to the slide rail or to adapt it to the given snow conditions, it is known to provide a latching device, with which the binding element can be fixed in different positions on the slide rail.

Such a locking device for cross-country bindings is already known for example from WO 2015/140258 A1, with which the latching lever mounted pivotably cooperates with a binding-side latching projection. Latching elements projecting from the latching lever are provided here to be received in latching openings provided in the slide rail, in order to position the binding element with respect to the binding plate. In a preferred example of embodiment, the lever element is arranged in a pretensioned release position and can be transferred by means of a slide into the blocking position. A drawback here is in particular that the elastic pretensioning of the plastic material is dependent, amongst other things, on the temperature and the age of the binding element, so that a transfer into the release position is not ensured.

Furthermore, a cross-country binding with a binding plate is known for example from EP 2 090 338 A1, on which binding plate a binding element is mounted displaceably. In order to fix the position of the binding element with respect to the binding plate, the binding plate comprises a plurality of openings, in which an end-side latching hook of the binding element can be received. For the purpose of opening, however, a tool is required, such as for example a screwdriver or suchlike.

Furthermore, AT 385 204 B shows a latching device for ski binding parts, wherein a spring-loaded piston is provided, which can be latched against the force of a spring in a hole of a series of holes in the guide rail. For the transfer of the piston into a non-engagement position out of the engagement position, a pin can be provided, which is accommodated in an oblique link guide, or a slide can be provided which comprises different ramp-shaped run-on surfaces for displacing the piston out of a latching position into a release position.

DE 34 28 566 A1 also discloses a similar device, wherein here a base plate comprises lateral guide rails, which are accommodated in grooves of the carriage for the displaceable bearing of the carriage. By means of a pressure load of a pressure piece, a bolt can be released from a cutout and the carriage can be displaced with respect to the base plate.

Furthermore, CH 177 960 A shows a carriage mounted displaceably on a base plate. In order to release the carriage for a displacement or however to fix it in its position with respect to the base plate, a cam lever is provided, by means of which the carriage and the base plate are held frictionally engaged in a locking position.

A similar cross-country binding, with which a tool is also required in order to bring a latching element of the binding element out of a latching connection with a binding plate, is also known from US 2013/0241179 A1.

The aim of the invention, therefore, is to provide a ski binding of the type mentioned at the outset, with which the latching elements can be reliably transferred into a release position in a simple and efficient manner reliably and without a tool, in which release position the binding element can be changed in its position with respect to the slide rail.

According to the invention, this is achieved by the fact that the binding element comprises an operating element with an oblique run-on surface, which operating element can be transferred between an open position and a closed position, wherein the oblique run-on surface of the operating element, when the operating element is transferred into the open position, cooperates with an oblique contact surface of the lever element in such a way that the lever element is moved out of the blocking position.

With the aid of the operating element according to the invention, the lever element can thus be reliably moved, in particular lifted, out of a latched position with the ski-side latching element with the aid of the cooperating run-on/contact surfaces, and it can thus be ensured in a straightforward and reliable manner that, by means of a simple displacement of the operating element from a closed position into an open position, the lever element of the latching device is released from the blocking position and is transferred into the displacement position, so that the binding element is released for displacement on the slide rail. Ski-side latching element is understood to mean a latching element which is connected either directly to the ski or to the slide rail or is also constituted integrally and thus cooperates with a latching element of the binding element in the blocking position for fixing the position of the binding element with respect to the slide rail or the ski on which the slide rail is fixedly arranged in the state when in use.

The oblique run-on surfaces and contact surfaces of the operating element and of the lever element can be constituted either flat or curved. It should merely be ensured that, when the operating element is transferred from the closed position into the open position, the cooperating run-on surfaces and contact surfaces do not block one another when the lever element is released from the blocking position.

In order to ensure that the lever element is arranged reliably in a blocking position and thus to prevent as far as possible an inadvertent release of the latching connection during use—irrespective of the ambient temperatures or the creep behaviour of the plastic material of the lever element—it is advantageous if the lever element is constituted such that it is arranged in a relaxed initial position in the blocking position. No special blocking element or suchlike is therefore required for the transfer of the lever element into a blocking position, but rather the lever element is advantageously located—insofar as no external forces are acting thereon—in its blocking position, so that a reliable latching connection is achieved.

In order to increase the ease of use for the user, it is advantageous if the lever element does not have to be continuously held during the displacement process of the binding element on the slide rail, but rather can be fixed in a straightforward manner in its open position. In this connection, it is advantageous if the operating element and the lever element comprise cooperating displacement-latching elements, which snap into one another when the operating element is transferred into the open position. With the aid of these displacement-latching elements, the operating element, when being transferred into its open position, can thus be held in the open position in a straightforward manner—without a tool—by snapping-in the cooperating displacement-latching elements in a manner that is preferably also tactile and audible for the user, so that the binding element can easily be displaced with respect to the slide rail. Accordingly, it is advantageously not necessary on the one hand to hold the lever element in its open position and at the same time to displace the binding element with respect to the slide rail, this sometimes requiring a certain amount of dexterity on the part of the user with known ski bindings.

With regard to a structurally simple embodiment of the displacement-latching elements for the purpose of the latching connection between the operating element and the lever element in the open position of the operating element, it is advantageous if a preferably web-shaped latching tab and a preferably linear latching groove for receiving the latching tab are provided as displacement-latching elements. Accordingly, only a projecting web, in particular on the operating element, and a corresponding groove-shaped depression, preferably on the lever element, are advantageously provided, so that the two elements, when the operating element is transferred, are brought into a latching connection which can also be released again in a straightforward manner.

It is also advantageous for ease of use on the part of the user if he experiences tactile or audible feedback not only when the operating element is transferred into the open position, to the effect that the operating element has now been successfully transferred into the open position, but that the same also applies for the transfer into the closed position.

Accordingly, it is advantageous if the operating element and an essentially plate-shaped base element of the binding element comprise cooperating blocking-latching elements, which snap into one another when the operating element is transferred into the closed position. When the operating element is transferred, a latched position of the operating element is thus achieved when the closed position is reached, so that the user is confident that the binding element is now arranged in the blocking position.

With regard to a structurally simple embodiment of the blocking-latching elements, it is advantageous if the operating element comprises an elastically deformable groove as a blocking-latching element, in which groove a preferably pin-shaped blocking-latching element connected to the plate-shaped base element snaps in in the closed position.

With regard to a compact structure of the binding element, it is also advantageous if the operating element is accommodated movably in a recess of the plate-shaped base element of the binding element. By providing a recess in the plate-shaped base element, the operating element can be integrated in a practical and elegant manner into the plate-shaped base element of the binding element and can be mounted inside this recess, in particular displaceably or pivotably, for the transfer between the open position and the closed position.

With regard to a structurally simple embodiment for the displaceable bearing of the operating element in the recess of the base element, it is advantageous if the operating element comprises edge-side webs, which cooperate with guide webs of the plate-shaped base element which guide webs project at the edge side into the recess.

To further increase the certainty that the lever element remains in the blocking position when the operating element is arranged in the closed position, it is also advantageous if the operating element comprises a securing section which, in the blocking position, is arranged at least in sections overlapping with at least one securing surface of the lever element.

With regard to a structurally simple embodiment with a small overall height, it is advantageous here if, as a securing section, securing surfaces projecting laterally from an essentially rectangular lever arm are provided at the free end of the lever element, the upper side of which securing surfaces is arranged below the upper side of the lever arm.

Accordingly, the operating element advantageously encompasses the lever arm in sections in the manner of a bracket, wherein, in the blocking position of the operating element, an end-side securing section of the lever element is then covered by a section of the operating element, so that pivoting of the lever element—against its relaxed initial position—is additionally prevented; the lever arm is thus secured in its blocking position.

In order to fix the vertical position of the operating element, i.e. normal to the displacement direction of the operating element, in the closed position and thus to reliably prevent the lever element in the blocking position together with the operating element from being released from the blocking position, it is advantageous if the operating element and the recess comprise a groove/spring connection securing the operating element in its blocking position in a direction normal to the displacement direction of the operating element.

In order to separate the latching connection with the ski from the displaceable guide between the binding element and the slide rail and thus—on account of the difference stresses—to create for example the possibility of providing a different material for the latching element than for the slide rail, it is advantageous if the at least one latching element provided on the ski side is constituted in an engagement rail separate from the slide rail, which engagement rail is connected, in particular glued, preferably directly to the upper side of the ski.

With regard to a reliable latching connection in the blocking position, which reliably prevents an inadvertent release in both possible displacement directions, it is advantageous if the ski-side latching element comprises at least one, in particular cylindrical, receiving opening, preferably a plurality of receiving openings arranged spaced apart from one another at equal distances.

In order to achieve an intimate latching connection, it is correspondingly advantageous if the binding-side latching element comprises at least one pin-shaped latching element, wherein it has proved to be advantageous if at least two pin-shaped latching elements are provided.

However, it is of course also possible to provide other different types of receiving openings or projecting latching elements, which prevent an inadvertent release under the effect of force in one of the two possible displacement directions on the binding element.

In order to enable particularly easy handling when transferring the operating element between the open position and closed position, it is furthermore advantageous if the operating element comprises at least one depression and/or recess at an upper side facing away from the slide rail.

The invention is explained in greater detail below with the aid of preferred examples of embodiment, to which however it is on no account intended to be limited.

DETAILED DESCRIPTION

Figure 1:
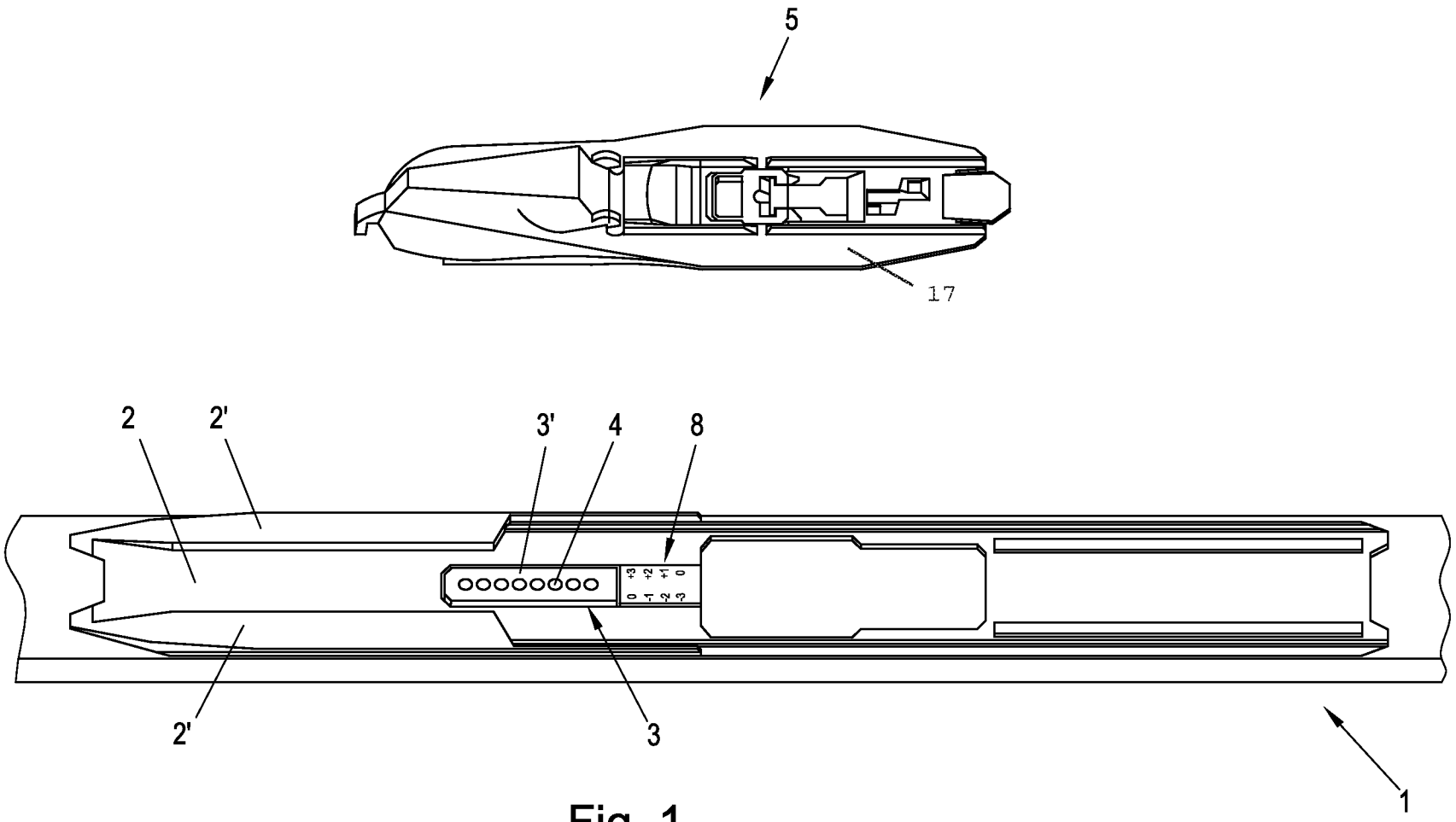
FIG. 1 shows a perspective view of a ski with a slide rail fastened thereon and a binding element not arranged on the slide rail.

A ski 1 can be seen in FIG. 1, on which a slide rail or binding plate 2 is arranged. Slide rail 2 is screwed and/or glued to ski 1 or can be constituted in one piece with an upper laminate of ski 1.

In the example of embodiment shown, a latching element 3 constituted separate from slide rail or binding plate 2 is provided in the form of a latching rail or engagement rail 3', which comprises a multiplicity of receiving openings 4 constituted essentially cylindrical. Latching rail 3' is accommodated in a recess of slide rail 2 and—separate from slide rail 2—is connected, in particular glued and/or screwed, to ski 1.

Figure 3:
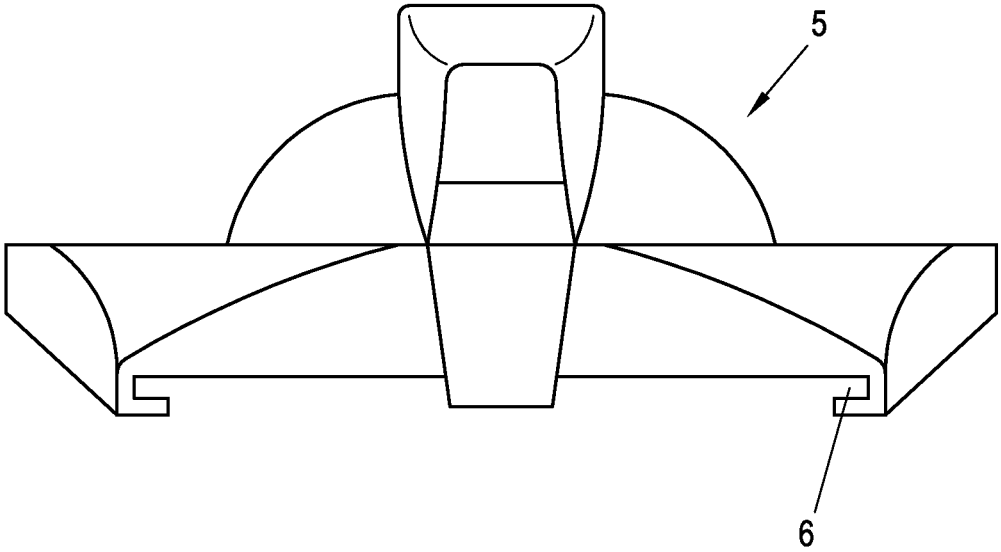
FIG. 3 shows a view of the end face of the binding element.

Slide rail 2 comprises slide rails 2' which project at the longitudinal edges, in a manner known per se, and which, for the displaceable mounting of a binding element 5, are accommodated in groove-shaped depressions 6 of binding element 5 (see FIG. 3), when binding element 5 is pushed onto slide rail 2.

Figure 2:
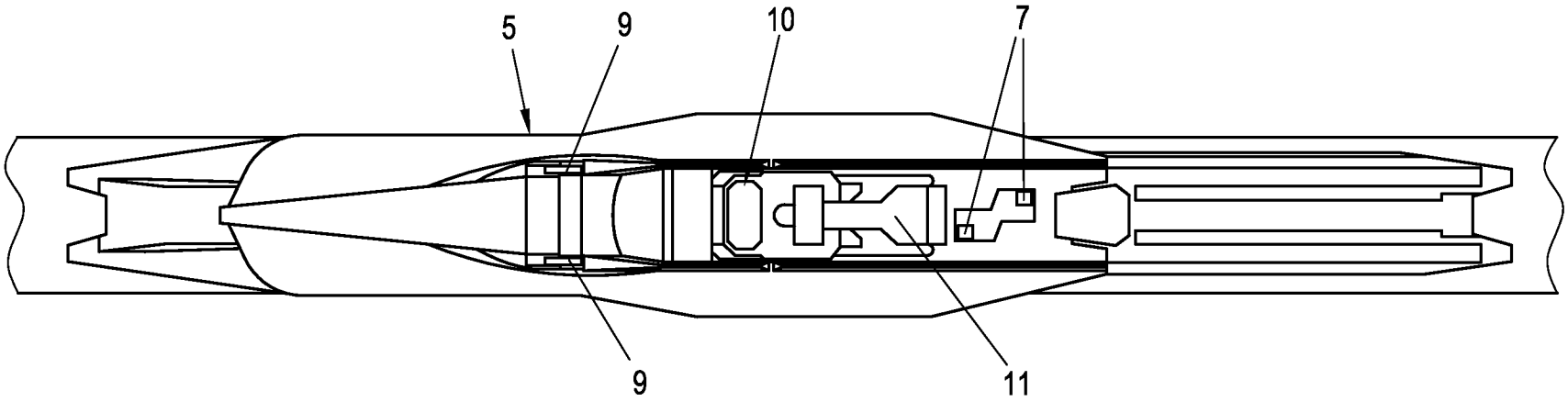
FIG. 2 shows the binding element according to FIG. 1 in a latched blocking position pushed onto the slide rail.

Binding element 5 in a position pushed onto slide rail 2 is then shown in FIG. 2, wherein it can be seen that binding element 5 comprises two viewing windows 7, through which a view of a position indicator 8 on the upper side of the slide rail 2 is possible.

Furthermore, it can be seen that binding element 5 comprises in the front end section two hook-shaped holding elements 9 for use as a cross-country binding or telemark binding, which holding elements are provided for receiving a pivot axle of a ski boot. In the position fastened on binding element 2, therefore, a ski boot, in particular a cross-country or telemark boot, is mounted pivotable about the pivot axle accommodated in holding elements 9.

Figure 4:
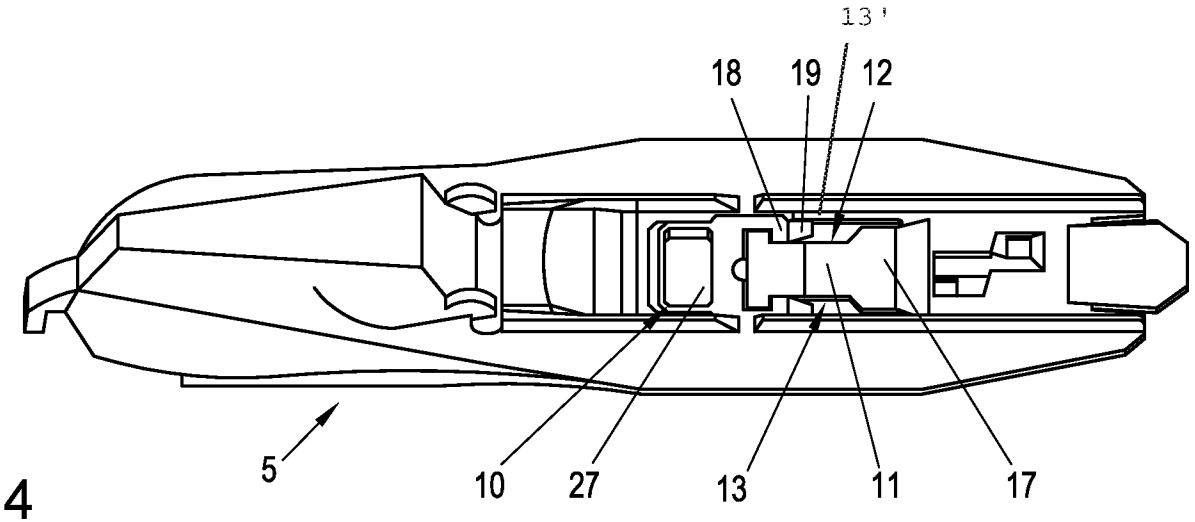
FIG. 4 shows a view of the binding element in the blocking position.
Figure 5:
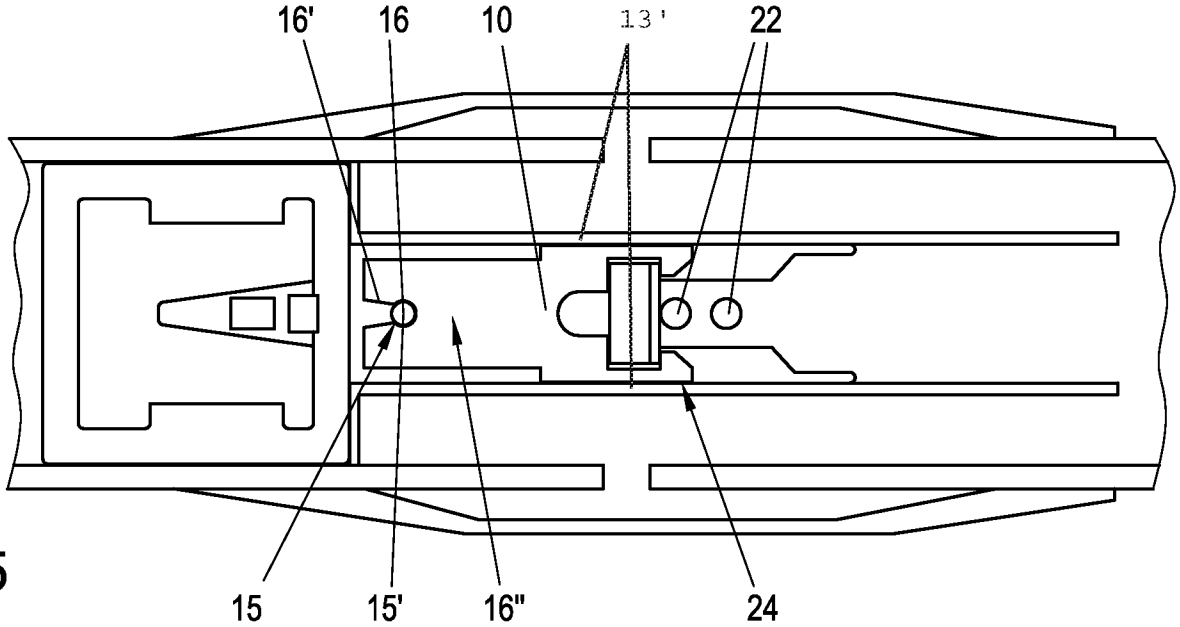
FIG. 5 shows a view from below of the binding element in the blocking position.

In particular in FIGS. 4 and 5, an operating element 10 can also be seen, which is arranged in a closed position, in which a latching element 11, which can be actuated by operating element 10, is arranged in its blocking position. Operating element 10 is mounted, in particular displaceably, between the closed position and an open position (see FIG. 9) in a recess 13 in a plate-shaped base element 17 of binding element 5. For this purpose, recess 13 comprises laterally projecting guide webs 13', on which the operating element is mounted displaceably with lateral webs 10" (see FIG. 10B), wherein—as can also be seen in FIG. 9—operating element 10 in the open position is also pivoted slightly by the elastic restoring force of lever element 12.

Figure 6:
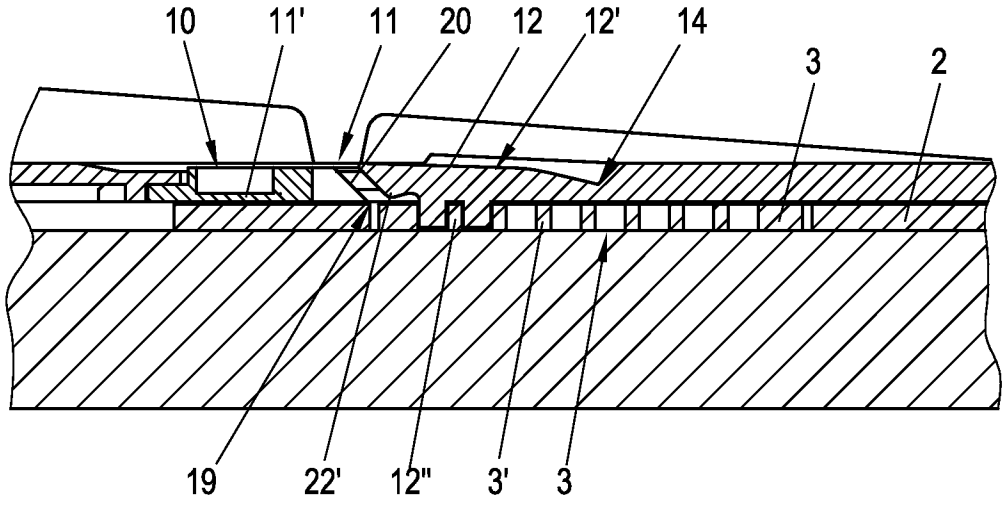
FIG. 6 shows a cross-sectional view of the binding element pushed onto the slide rail in the blocking position.

As can be seen in particular in FIG. 6, a lever element 12 is provided as a binding-side latching element 11, which lever element 12 is arranged in a blocking position or latching position in such a way that latching pins 12" connected to a lever arm 12' are received in corresponding receiving openings 4 in latching rail 3', said receiving openings being cylindrical in the example of embodiment shown.

Lever element 12 is positioned here in its relaxed initial position, such that pivoting of lever element 12 out of its relaxed initial position is required for release of lever element 12 out of the blocking position. For this purpose, operating element 10 is provided, with which the lever element 12 can be deflected essentially about a pivot axis 14 (see in particular also FIG. 9).

In the cross-sectional view according to FIG. 6, it can also be seen that operating element 10 is arranged in a latched closed position in the blocking position of lever element 12 shown in FIGS. 3 to 6. Blocking-latching elements 15, 16 are provided for this purpose.

In the example of embodiment shown, a pin-shaped latching element 15', which is arranged at the underside of essentially plate-shaped base element 17 of binding element 5, and a groove 16' in operating element 10 are provided as blocking-latching elements 15, 16. Groove 16' is constituted tapered from an entry opening to a narrow point, which is adjoined in the latched position by a cylindrical latching opening 16" for receiving pin-shaped latching element 15'. At the transfer over the narrow point, groove 16' therefore widens elastically, so that in the latching position pin-shaped latching element 15' then snaps in. When operating element 10 is transferred into the closed position which can be seen in particular in FIG. 5, the reaching of the closed position is therefore audible or perceptible in a tactile manner to the user on account of the snap-in process; the same applies—as is also explained in detail below—to the transfer of operating element 10 into the open position.

Figure 10A:
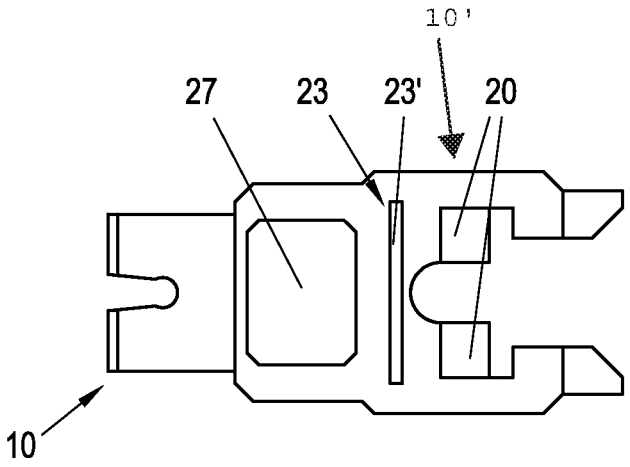
FIG. 10A shows in detail a plan view of an operating element of the binding element.
Figure 10B:
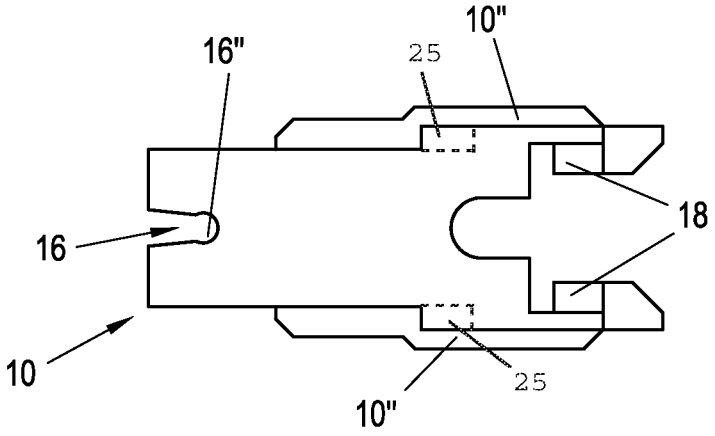
FIG. 10B shows in detail a view from below of the operating element according to FIG. 10A.

It can also be seen in FIG. 4 that operating element 10 comprises a securing section 18 in an end section directed towards lever element 12, which securing section cooperates with a securing section 19 of lever element 12 (see FIG. 10B). Operating element 10 and lever element 12 are constituted in such a way that securing section 18 of operating element 10, in the blocking position shown in FIG. 6, overlaps securing surfaces 19' (see also FIG. 10B and FIG. 11) of lever element 12 which securing surfaces 19' project laterally from lever arm 12' in securing section 19. In the blocking position of operating element 10, therefore, pivoting of lever element 12 into a displacement position, in which latching pin or pins 12" are released from receiving opening(s) 4, is reliably prevented.

In order to fix operating element 10 in the vertical direction in the closed position, a form-fit groove/spring connection 25, 26 is also provided between operating element 10 and base element 17 in the closed position. In the example of embodiment shown, operating element 10 comprises lateral grooves 25 and recess 13 in base element 17 comprises springs or hold-down webs 26 projecting laterally over a part of the length extension of recess 13. When operating element 10 is transferred into the closed position, hold-down webs 26 projecting laterally into recess 13 are thus each received in grooves 25, so that the vertical position of operating element 10 in its closed position is defined by the form-fit groove/spring connections.

Figure 9:
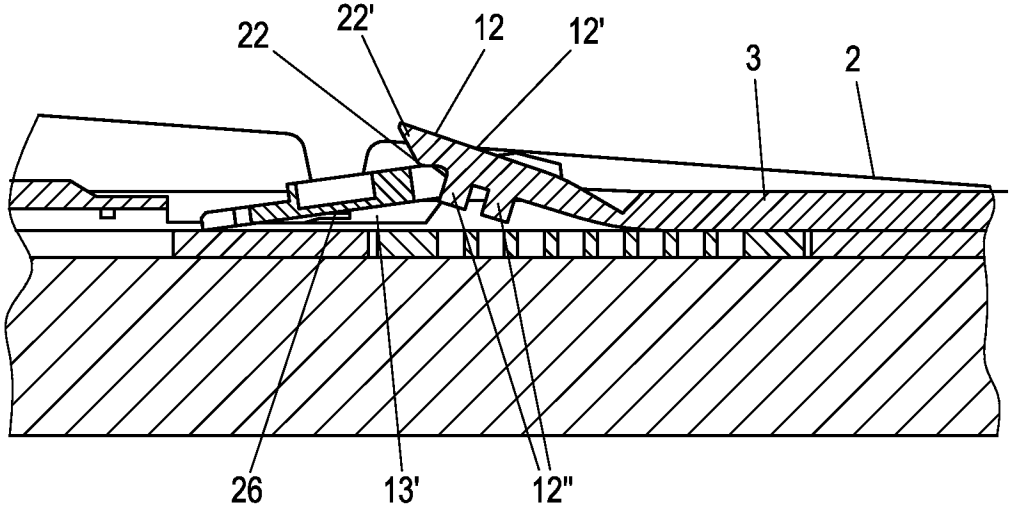
FIG. 9 shows a cross-sectional view of the binding element pushed onto the slide rail in the displacement position or open position of the operating element.
Figure 7:
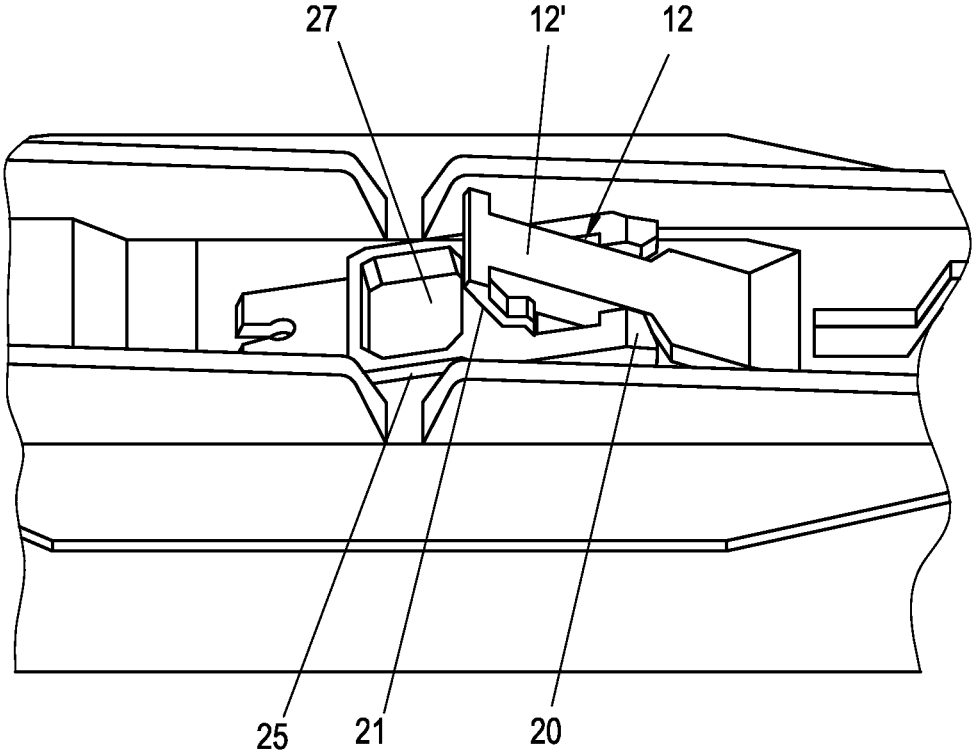
FIG. 7 shows a perspective view of the binding element in the displacement position.
Figure 8:
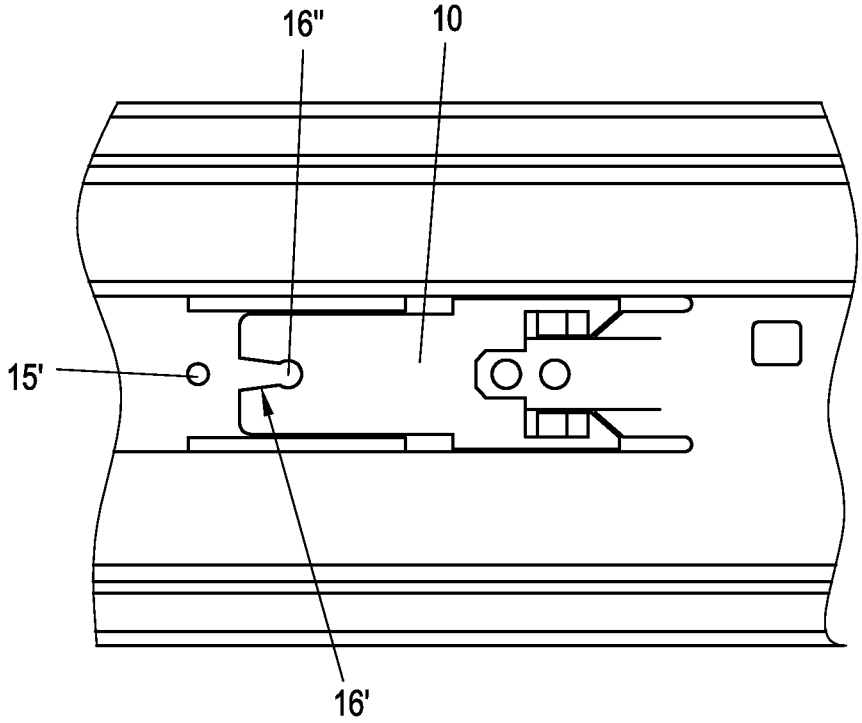
FIG. 8 shows a view from below of the binding element in the displacement position.

It can be seen in FIGS. 7 to 9 that in particular lever element 12 can be transferred into its displacement position with the aid of operating element 10.

For this purpose, operating element 10 is displaced in the direction of lever element 12, wherein the operating element 10 comprises oblique run-on surfaces 20 at its end section 10' facing towards lever element 12 (see also FIG. 10A), which run-on surfaces cooperate with lower oblique contact surface 21 of lever element 12, so that operating element 10 in the closed position represented in FIGS. 4 to 6 is released and lever element 12 is pivoted upwards out of the closed position. For easier handling, operating element 10 comprises a depression 27, in which a finger of the user can be accommodated for the purpose of displacing operating element 10.

Figure 11:
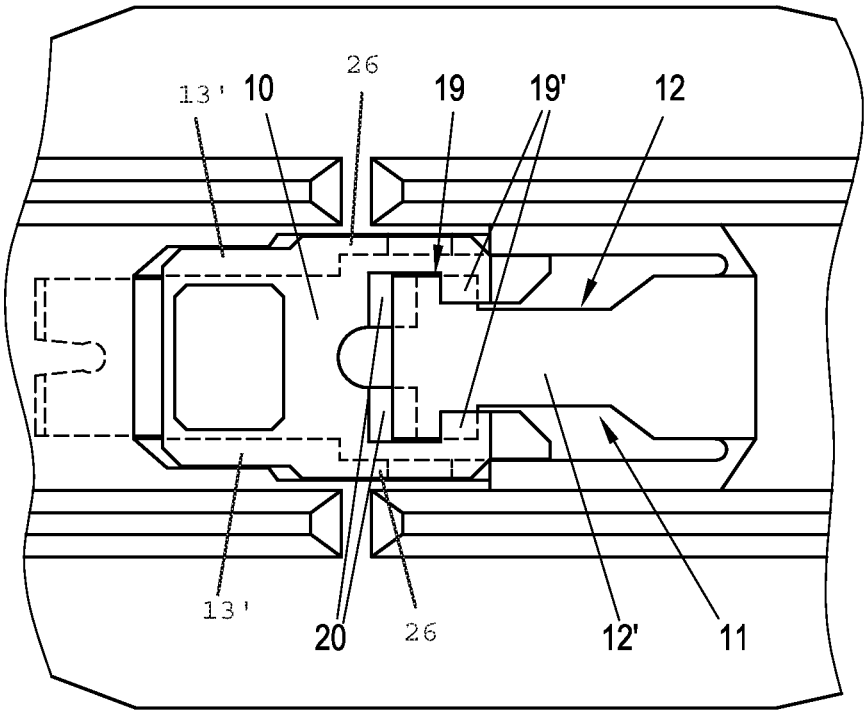
FIG. 11 shows in detail a plan view of the ski binding with the operating element in an intermediate position.

After lever element 12 has been pivoted upwards out of its essentially relaxed initial position with the aid of end-side run-on surface 20, latching pins 12" are brought out of engagement with receiving openings 4 of latching rail 3' by contact surface 21 of lever element 12, the contact surface 21 running onto run-on surface 20 of operating element 10 with further displacement—as can be seen in particular in the intermediate position of operating element 10 shown in FIG. 11, until operating element 10 arrives in the end or open position represented in FIG. 9.

When operating element 10 has reached its end or open position, a web 22', which is provided at the underside of the front end section of lever element 12, also snaps into a groove-shaped depression 23' (see FIG. 10A) of operating element 10. By means of this latching connection between web/groove connection 22', 23' constituted as displacement-latching elements 22, 23, lever element 12 is thus held in its displacement position, so that the user can easily displace binding element 5 on slide rail 2.

The user can also view through viewing window 7 position indicator 8 fitted on the slide rail and, as soon as the desired position is reached, lever element 12 is again returned into its relaxed initial position by a displacement of operating element 10 into the blocking position shown in particular in FIG. 6, so that latching pins 12 engage in corresponding cylindrical receiving openings 4 in latching rail 3', so that a displacement of binding element 5 with respect to the slide rail is not possible in the then reached blocking position of lever element 12 or the closed position of operating element 10.

A ski binding that can be operated easily and without tools is thus created with the device according to the invention, with which the position of the ski binding with respect to ski 1 or a slide rail 2 can be changed in a straightforward and easy manner.

The invention claimed is:

1. A ski binding with a binding element, which is mounted displaceably on a slide rail provided for arrangement on a ski and the arrangement of the binding element, viewed in a longitudinal direction of the slide rail, is fixable in different positions by means of a latching device, wherein the latching device comprises latching elements which engage in each other in a blocking position on a binding side and on a ski side, and the binding-side latching element comprises a lever element which is pivotable about a pivot axis in such a way that, in a displacement position, the latching elements are not in engagement with each other and the binding element is mounted displaceably with respect to the slide rail, wherein the binding element comprises an operating element with an oblique run-on surface, which operating element is transferrable between an open position and a closed position, wherein the oblique run-on surface of the operating element, when the operating element is transferred into the open position, is cooperating with an oblique contact surface of the lever element in such a way that the lever element is moved out of the blocking position.

2. The ski binding according to claim 1, wherein the lever element is constituted such that it is arranged in a relaxed initial position in the blocking position.

3. The ski binding according to claim 1, wherein the operating element and the lever element comprise cooperating displacement-latching elements, which are snappable into one another when the operating element is transferred into the open position.

4. The ski binding according to claim 3, wherein a web-shaped latching tab and a linear latching groove for receiving the latching tab are provided as displacement-latching elements.

5. The ski binding according to claim 1, wherein the operating element and an essentially plate-shaped base element of the binding element comprise cooperating blocking-latching elements, which are snappable into one another when the operating element is transferred into the closed position.

6. The ski binding according to claim 5, wherein the operating element comprises an elastically deformable groove as a blocking-latching element, in which groove a pin-shaped latching element connected to the plate-shaped base element snaps home in the closed position.

7. The ski binding according to claim 5, wherein the operating element is accommodated movably in a recess of the plate-shaped base element of the binding element.

8. The ski binding according to claim 7, wherein the operating element comprises edge-side webs, which cooperate with guide webs of the plate-shaped base element, which guide webs project at the edge side into the recess.

9. The ski binding according to claim 1, wherein the operating element comprises a securing section which, in the blocking position, is arranged at least in sections overlapping with at least one securing section of the lever element.

10. The ski binding according to claim 9, wherein, as a securing section, securing surfaces projecting laterally from an essentially rectangular lever arm are provided at a free end of the lever element, an upper side of which securing surfaces is arranged below an upper side of the lever arm.

11. The ski binding according to claim 9, wherein the operating element and the recess comprise a groove/spring connection securing the operating element in its blocking position in a direction normal to the displacement direction of the operating element.

12. The ski binding according claim 1, wherein the at least one latching element provided on the ski side is constituted as an engagement rail separate from the slide rail, which engagement rail is connected to the upper side of the ski.

13. The ski binding according to claim 1, wherein the ski-side latching element comprises at least one receiving opening.

14. The ski binding according to claim 1, wherein the binding-side latching element comprises at least one pin-shaped latching element.

15. The ski binding according to claim 1, wherein the operating element comprises at least one depression and/or recess at an upper side facing away from the slide rail.

16. The ski binding according to claim 1, wherein the ski binding is a cross-country binding.

17. The ski binding according to claim 12, wherein the engagement rail is glued directly to the upper side of the ski.

18. The ski binding according to claim 13, wherein the at least one receiving opening is cylindrical.

19. The ski binding according to claim 13, wherein the ski-side latching element comprises a plurality of receiving openings arranged spaced apart from one another at equal distances.

* * * * *